US011821378B2

(12) United States Patent
Dudar

(10) Patent No.: US 11,821,378 B2
(45) Date of Patent: Nov. 21, 2023

(54) METHOD AND SYSTEM FOR DEICING AN ENGINE

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 192 days.

(21) Appl. No.: 17/302,754

(22) Filed: May 11, 2021

(65) Prior Publication Data

US 2022/0364521 A1 Nov. 17, 2022

(51) Int. Cl.

| | |
|---|---|
| ***F02D 41/00*** | (2006.01) |
| ***F02M 35/08*** | (2006.01) |
| ***F02M 25/08*** | (2006.01) |

(52) U.S. Cl.

CPC ..... *F02D 41/0035* (2013.01); *F02D 41/0002* (2013.01); *F02D 41/004* (2013.01); *F02M 25/08* (2013.01); *F02M 35/088* (2013.01); *F02D 2200/503* (2013.01); *F02M 2025/0881* (2013.01)

(58) Field of Classification Search

CPC ..... F02D 41/0035; F02D 41/0002; F02D 41/004; F02D 2200/503; F02M 25/08; F02M 35/088; F02M 2025/0881

USPC ..... 123/520

See application file for complete search history.

(56) References Cited

U.S. PATENT DOCUMENTS

| | | | | |
|---|---|---|---|---|
| 7,210,452 | B2 | 5/2007 | Nakashima et al. | |
| 9,175,619 | B2 | 11/2015 | Whitehead et al. | |
| 9,260,990 | B2 | 2/2016 | Rollinger et al. | |
| 9,739,244 | B2 | 8/2017 | Dudar | |
| 10,471,966 | B2 | 11/2019 | Dudar | |
| 10,513,997 | B2 | 12/2019 | Dudar | |
| 10,774,760 | B2 | 9/2020 | Dudar | |
| 2009/0194078 | A1* | 8/2009 | Miyazaki | F02D 9/104 123/549 |
| 2017/0082038 | A1* | 3/2017 | Dudar | F02D 41/0045 |
| 2017/0204796 | A1* | 7/2017 | Dudar | F02M 25/089 |
| 2020/0240375 | A1* | 7/2020 | Kroon | B01D 46/0002 |

* cited by examiner

*Primary Examiner* — Scott A Reinbold

(74) *Attorney, Agent, or Firm* — Vincent Mastrogiacomo; McCoy Russell LLP

(57) ABSTRACT

Methods and systems for deicing an engine air intake filter and an engine throttle are described. The methods and systems may include activating an evaporative emissions system heater and a pump to de-ice the engine air intake filter and the engine throttle. The deicing may be performed when an engine of a vehicle is not operating.

20 Claims, 5 Drawing Sheets

METHOD AND SYSTEM FOR DEICING AN ENGINE

FIELD

The present description relates generally to methods and systems for deicing components of an internal combustion engine.

BACKGROUND/SUMMARY

A vehicle may operate in cold weather from time to time. The cold weather may cause throttle icing, which may tend to hold a throttle in a closed position. Throttle icing may limit engine torque and degrade vehicle drivability. Therefore, it may be desirable to overcome the effects of throttle icing. In addition, an engine's air filter may become packed with snow and/or ice if the vehicle is parked in or next to a snow pile. An air filter that is packed with ice may also limit engine power. A packed air filter may also reduce engine fuel economy and increase engine emissions. Therefore, it may be desirable to overcome cold weather conditions to improve vehicle operation.

The inventors herein have recognized the above-mentioned issue and have developed a vehicle system, comprising: an engine including an intake air filter; an evaporative emissions system heater; an evaporative emissions system bi-directional pump; and a controller including executable instructions stored in non-transitory memory that cause the controller to activate the evaporative emissions system heater and the evaporative emissions system bi-directional pump in response to an indication of icing of the intake air filter.

By activating an evaporative emissions system heater and an evaporative emissions system bi-directional pump, it may be possible to provide the technical result of reducing throttle and intake air filter icing. Specifically, air may be pumped by the bi-directional pump through a heating element of an evaporative emissions system and into an intake manifold of an engine. The heated air may flow to the throttle and air filter so as to melt ice that may have accumulated at the throttle and/or at the air filter.

The present description may provide several advantages. In particular, the approach may de-ice a throttle and an air filter of an engine intake. Additionally, the approach may be implemented with existing components of an evaporative emissions system so that system cost may not be increased. Further, the approach may improve vehicle fuel economy and emissions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
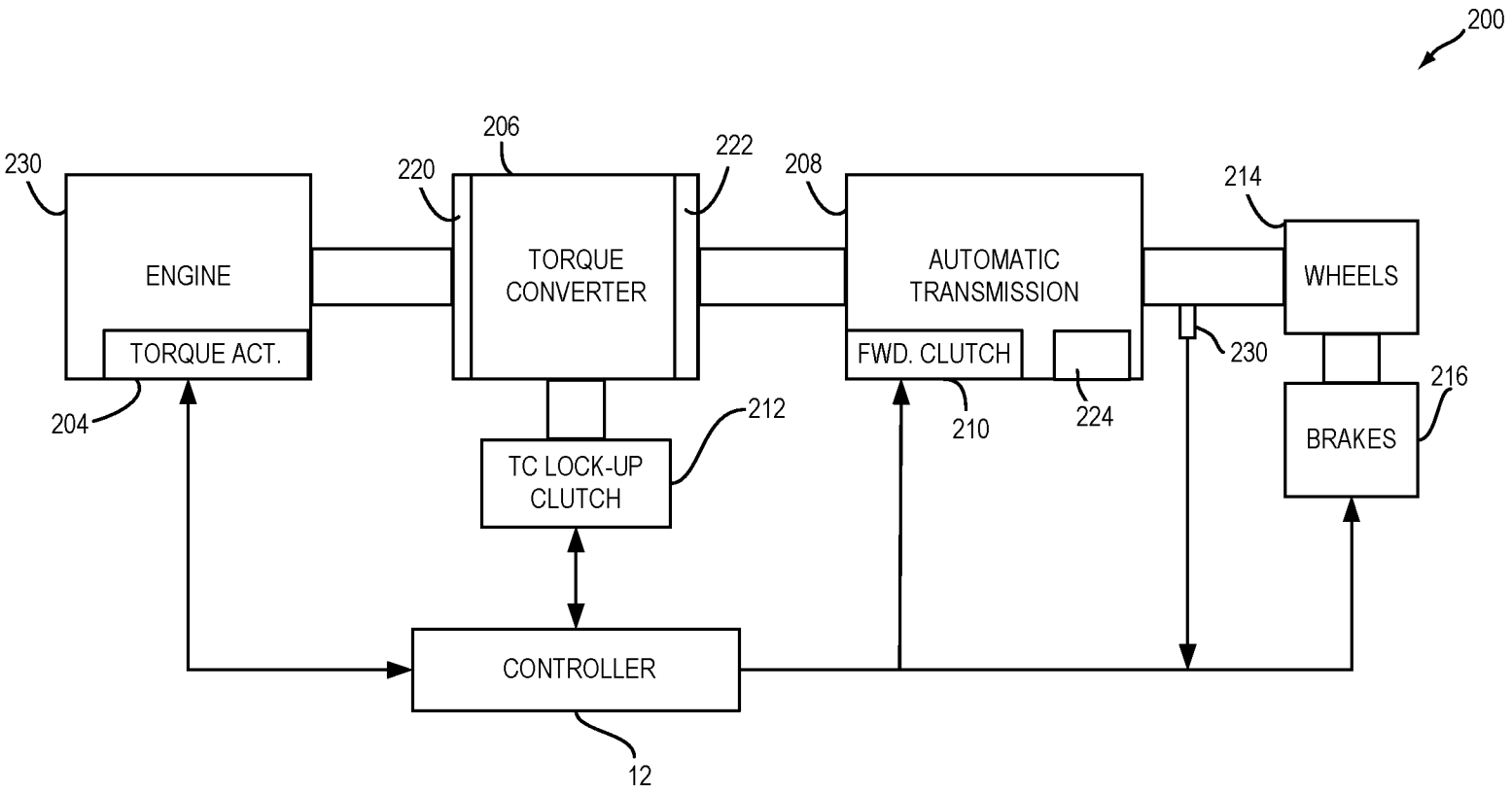
FIG. 2 shows an example powertrain of the vehicle that includes the engine.
Figure 3:
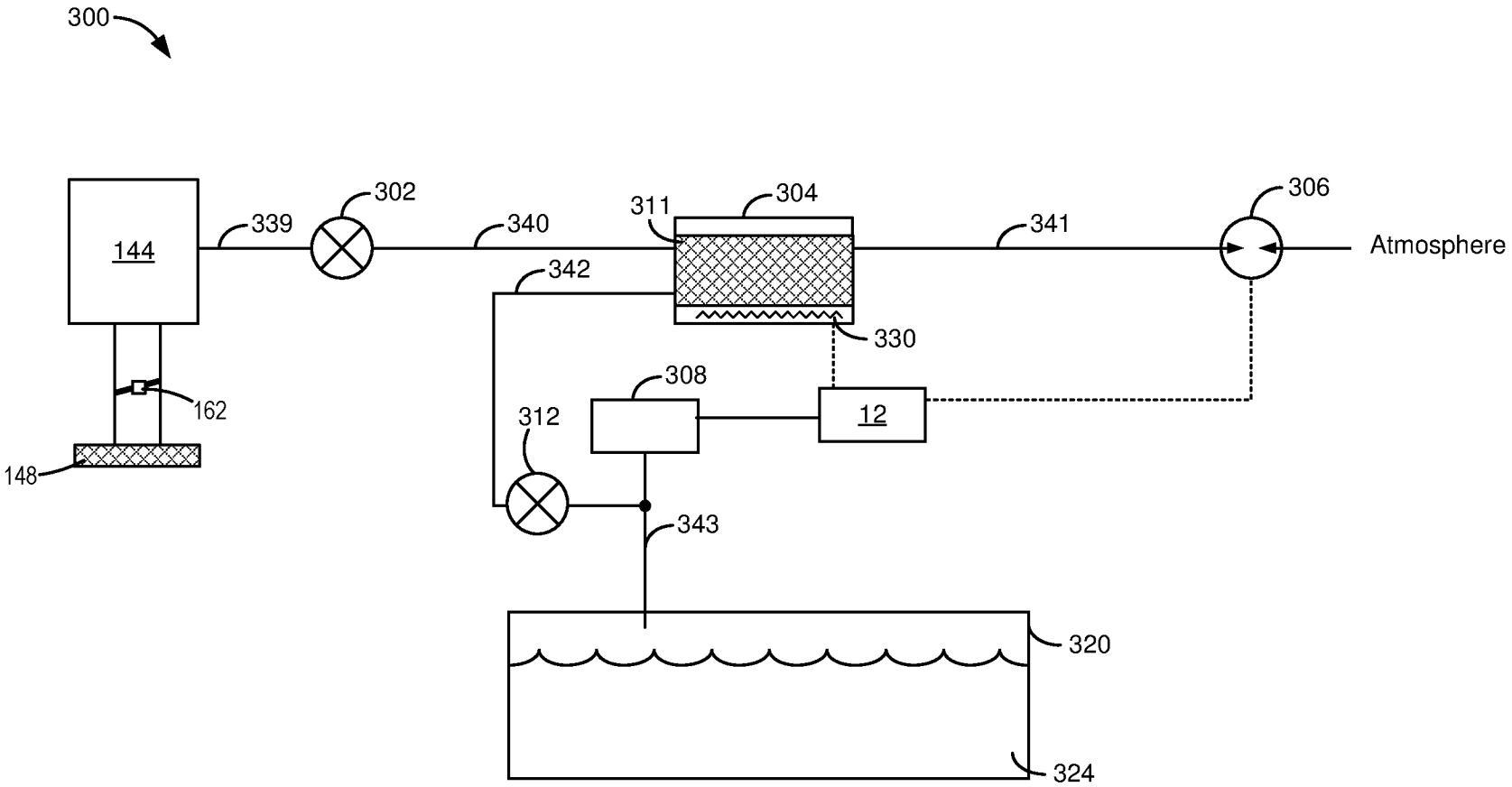
FIG. 3 shows a block diagram of an example evaporative emissions system for the vehicle.
Figure 4:
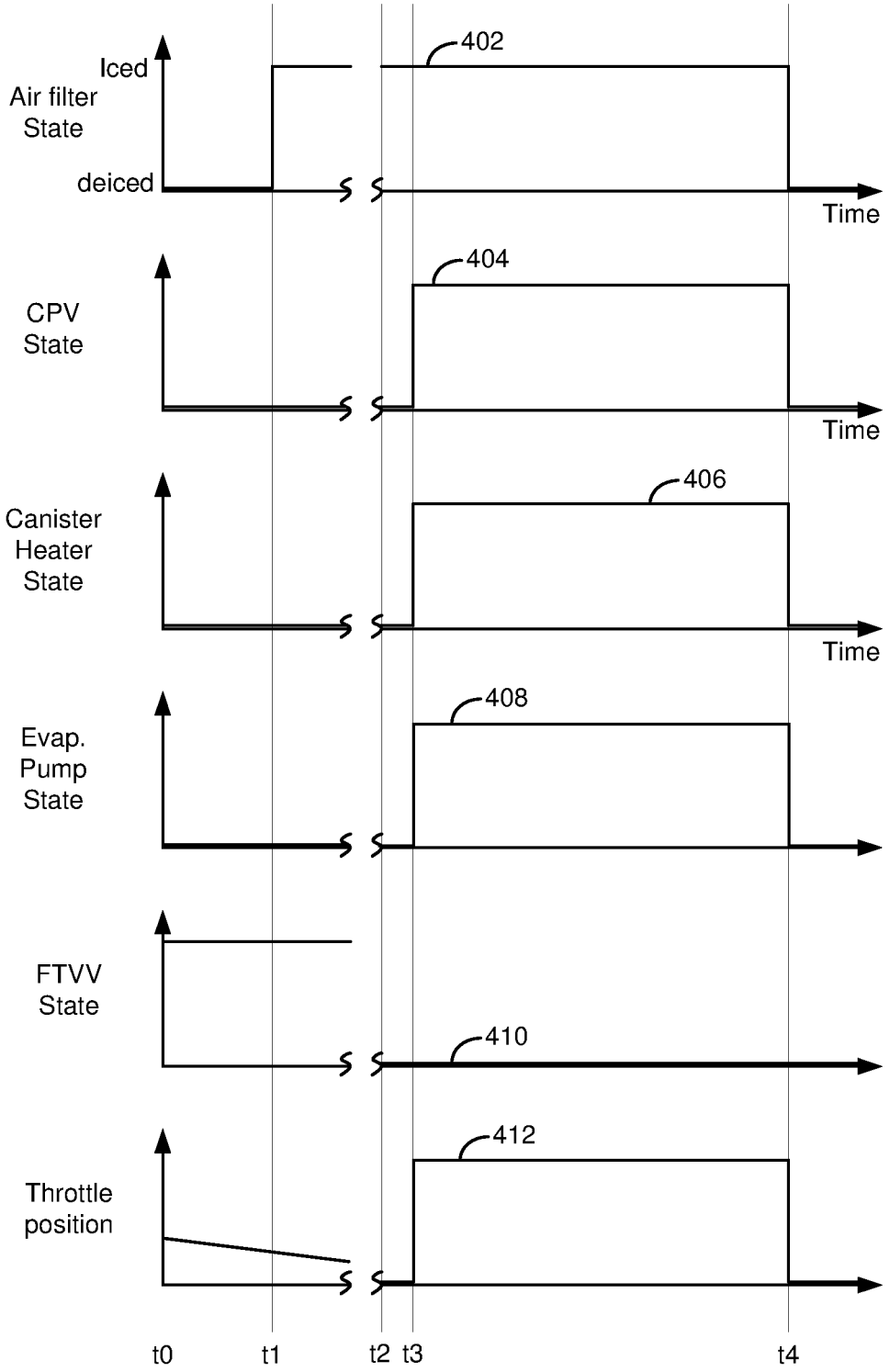
FIG. 4 shows an example evaporative emission system operating sequence according to the method of FIG. 5.
Figure 5:
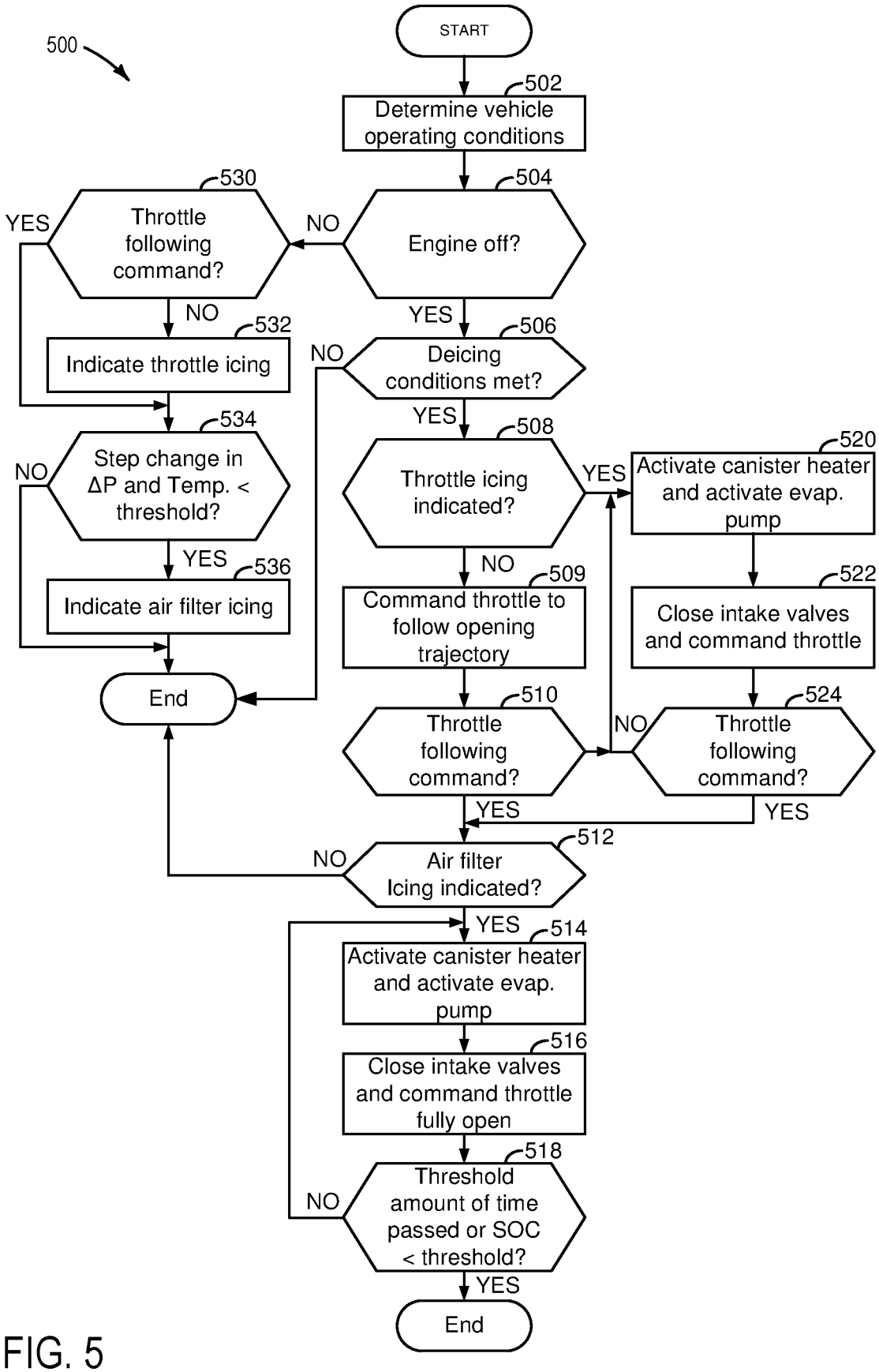
FIG. 5 shows an example method for operating an engine.

The following description relates to systems and methods for deicing components of an internal combustion engine intake system. In particular, an intake air filter and an intake throttle may be de-iced when an engine is not operating after an indication of icing is determined. The icing may occur on an engine of the type shown in FIG. 1. The engine may be part of a driveline or powertrain as shown in FIG. 2. The engine and powertrain may include an evaporative emissions system as shown in FIG. 3. A sequence for deicing an iced air filter according to the method of FIG. 5 is shown at FIG. 4. A method for deicing an intake air filter and an intake throttle is shown in FIG. 5.

Figure 1:
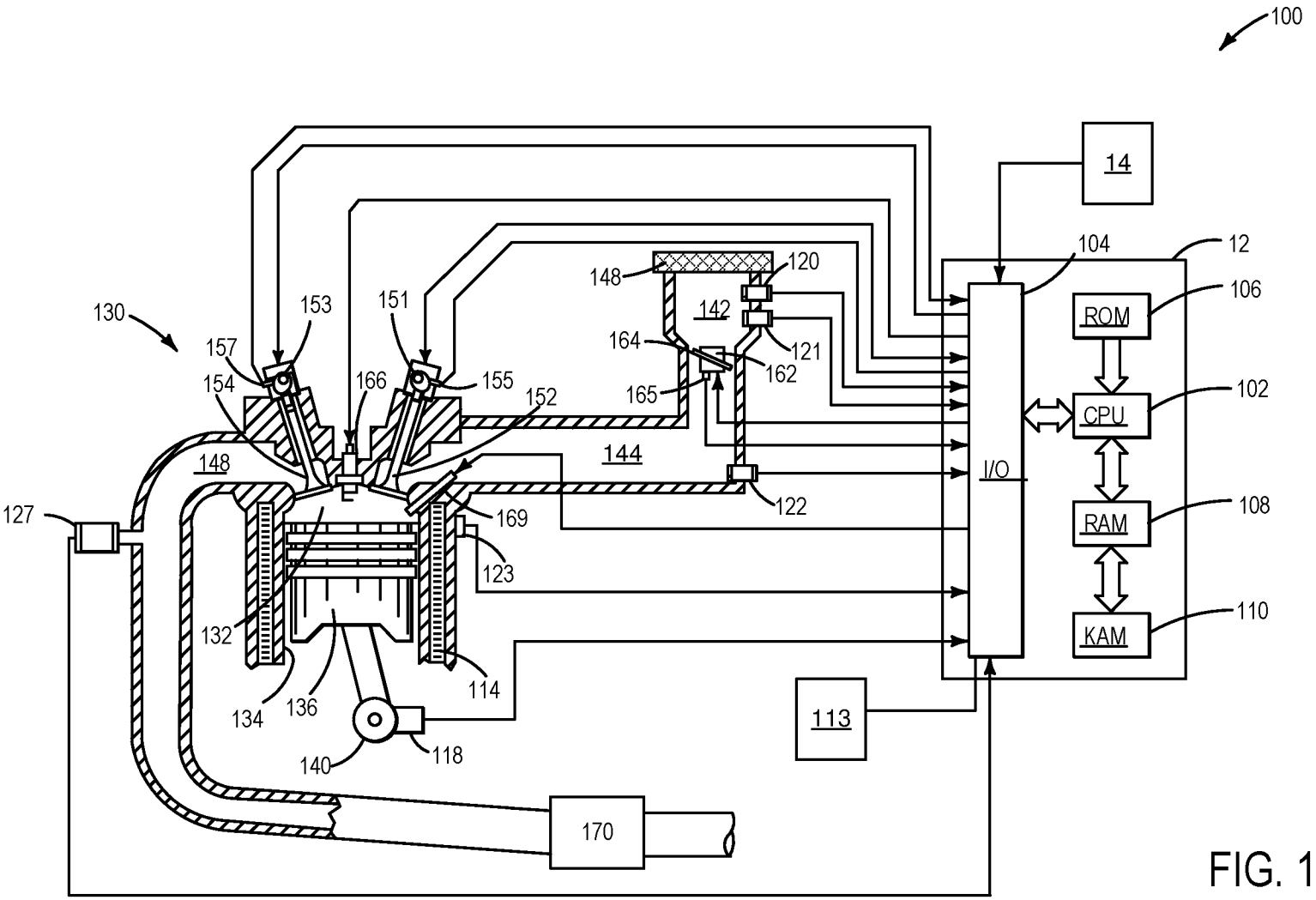
FIG. 1 shows an example internal combustion engine of a vehicle.

Referring now to FIG. 1, a schematic diagram showing one cylinder of a multi-cylinder engine 130 in an engine system 100 is shown. Engine 130 may be controlled at least partially by a control system including a controller 12 and by input from an autonomous driver or controller 14. Alternatively, a vehicle operator (not shown) may provide input via an input device, such as an engine torque, power, or air amount input pedal (not shown).

A combustion chamber 132 of the engine 130 may include a cylinder formed by cylinder walls 134 with a piston 136 positioned therein. The piston 136 may be coupled to a crankshaft 140 so that reciprocating motion of the piston is translated into rotational motion of the crankshaft. The crankshaft 140 may be coupled to at least one drive wheel of a vehicle via an intermediate transmission system. Further, a starter motor (not shown) may be coupled to the crankshaft 140 via a flywheel to enable a starting operation of the engine 130.

Combustion chamber 132 may receive intake air from an intake manifold 144 via an intake passage 142 and may exhaust combustion gases via an exhaust passage 148. The intake passage 142 includes an intake air filter 148. The intake manifold 144 and the exhaust passage 148 can selectively communicate with the combustion chamber 132 via respective intake valve 152 and exhaust valve 154. In some examples, the combustion chamber 132 may include two or more intake valves and/or two or more exhaust valves.

In this example, the intake valve 152 and exhaust valve 154 may be controlled by cam actuation via respective cam actuation systems 151 and 153. The cam actuation systems 151 and 153 may each include one or more cams and may utilize one or more of cam profile switching (CPS), variable cam timing (VCT), variable valve timing (VVT), and/or variable valve lift (VVL) systems that may be operated by the controller 12 to activate, deactivate (e.g., hold in a closed position for an engine cycle of two revolutions), and vary timing of valve operation. The position of the intake valve 152 and exhaust valve 154 may be determined by position sensors 155 and 157, respectively. In alternative examples, the intake valve 152 and/or exhaust valve 154 may be controlled by electric valve actuation. For example, the cylinder 132 may alternatively include an intake valve controlled via electric valve actuation and an exhaust valve controlled via cam actuation including CPS and/or VCT systems.

A fuel injector 169 is shown coupled directly to combustion chamber 132 for injecting fuel directly therein in proportion to the pulse width of a signal received from the controller 12. In this manner, the fuel injector 169 provides what is known as direct injection of fuel into the combustion chamber 132. The fuel injector may be mounted in the side of the combustion chamber or in the top of the combustion chamber, for example. Fuel may be delivered to the fuel injector 169 by a fuel system (not shown) including a fuel tank, a fuel pump, and a fuel rail. In some examples, the combustion chamber 132 may alternatively or additionally include a fuel injector arranged in the intake manifold 144 in a configuration that provides what is known as port injection of fuel into the intake port upstream of the combustion chamber 132.

Spark is provided to combustion chamber 132 via spark plug 166. The ignition system may further comprise an ignition coil (not shown) for increasing voltage supplied to spark plug 166. In other examples, such as a diesel, spark plug 166 may be omitted.

The intake passage 142 may include an intake throttle 162 having a throttle plate 164. In this particular example, the position of throttle plate 164 may be varied by the controller 12 via a signal provided to an electric motor or actuator included with the throttle 162, a configuration that is commonly referred to as electronic throttle control (ETC). In this manner, the throttle 162 may be operated to vary the intake air provided to the combustion chamber 132 among other engine cylinders. The position of the throttle plate 164 may be provided to the controller 12 by a throttle position signal. The intake passage 142 may include a mass air flow sensor 120, an intake inlet pressure sensor 121, and a manifold air pressure sensor 122 for sensing an amount of air entering engine 130.

An exhaust gas sensor 127 is shown coupled to the exhaust passage 148 upstream of an emission control device 170 according to a direction of exhaust flow. The sensor 127 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a $NO_x$, HC, or CO sensor. In one example, upstream exhaust gas sensor 127 is a UEGO configured to provide output, such as a voltage signal, that is proportional to the amount of oxygen present in the exhaust. Controller 12 converts oxygen sensor output into exhaust gas air-fuel ratio via an oxygen sensor transfer function.

The emission control device 170 is shown arranged along the exhaust passage 148 downstream of the exhaust gas sensor 127. The device 170 may be a three way catalyst (TWC), $NO_x$ trap, various other emission control devices, or combinations thereof. In some examples, during operation of the engine 130, the emission control device 170 may be periodically reset by operating at least one cylinder of the engine within a particular air-fuel ratio.

The controller 12 is shown in FIG. 1 as a microcomputer, including a microprocessor unit 102, input/output ports 104, an electronic storage medium for executable programs and calibration values shown as read only memory chip 306 (e.g., non-transitory memory) in this particular example, random access memory 108, keep alive memory 110, and a data bus. The controller 12 may receive various signals from sensors coupled to the engine 130, in addition to those signals previously discussed, including measurement of inducted mass air flow (MAF) from the mass air flow sensor 120; engine coolant temperature (ECT) from a temperature sensor 123 coupled to a cooling sleeve 114; an engine position signal from a Hall effect sensor 118 (or other type) sensing a position of crankshaft 140; throttle position from a throttle position sensor 165; and manifold absolute pressure (MAP) signal from the sensor 122. An engine speed signal may be generated by the controller 12 from crankshaft position sensor 118. Manifold pressure signal also provides an indication of vacuum, or pressure, in the intake manifold 144. Note that various combinations of the above sensors may be used, such as a MAF sensor without a MAP sensor, or vice versa. During engine operation, engine torque may be inferred from the output of MAP sensor 122 and engine speed. Further, this sensor, along with the detected engine speed, may be a basis for estimating charge (including air) inducted into the cylinder. In one example, the crankshaft position sensor 118, which is also used as an engine speed sensor, may produce a predetermined number of equally spaced pulses every revolution of the crankshaft.

The storage medium read-only memory 106 (e.g., non-transitory memory) can be programmed with computer readable data representing non-transitory instructions executable by the processor 102 for performing at least portions of the methods described below as well as other variants that are anticipated but not specifically listed. Thus, controller 12 may operate actuators to change operation of engine 130. In addition, controller 12 may post data, messages, and status information to human/machine interface 113 (e.g., a touch screen display, heads-up display, light, etc.).

During operation, each cylinder within engine 130 typically undergoes a four stroke cycle: the cycle includes the intake stroke, compression stroke, expansion stroke, and exhaust stroke. During the intake stroke, generally, the exhaust valve 154 closes and intake valve 152 opens. Air is introduced into combustion chamber 132 via intake manifold 144, and piston 136 moves to the bottom of the cylinder so as to increase the volume within combustion chamber 132. The position at which piston 136 is near the bottom of the cylinder and at the end of its stroke (e.g. when combustion chamber 132 is at its largest volume) is typically referred to by those of skill in the art as bottom dead center (BDC).

During the compression stroke, intake valve 152 and exhaust valve 154 are closed. Piston 136 moves toward the cylinder head so as to compress the air within combustion chamber 132. The point at which piston 136 is at the end of its stroke and closest to the cylinder head (e.g. when combustion chamber 132 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 166, resulting in combustion.

During the expansion stroke, the expanding gases push piston 136 back to BDC. Crankshaft 140 converts piston movement into a rotational torque of the rotary shaft. Finally, during the exhaust stroke, the exhaust valve 154 opens to release the combusted air-fuel mixture to exhaust manifold 148 and the piston returns to TDC. Note that the above is shown merely as an example, and that intake and exhaust valve opening and/or closing timings may vary, such as to provide positive or negative valve overlap, late intake valve closing, or various other examples.

As described above, FIG. 1 shows only one cylinder of a multi-cylinder engine, and each cylinder may similarly include its own set of intake/exhaust valves, fuel injector, spark plug, etc.

Referring now to FIG. 2, a schematic of a vehicle drive-train 200 is shown. Drive-train 200 may be powered by engine 130 as shown in greater detail in FIG. 1. In one example, engine 130 may be a gasoline engine. In alternate examples, other engine configurations may be employed, for example, a diesel engine. Engine 130 may be started with an engine starting system (not shown). Further, engine 130 may generate or adjust torque via torque actuator 204, such as a fuel injector, throttle, cam, etc.

An engine output torque may be transmitted to torque converter 206 to drive a step-ratio automatic transmission 208 by engaging one or more clutches, including forward clutch 210, where the torque converter may be referred to as a component of the transmission. Torque converter 206 includes an impeller 220 that transmits torque to turbine 222 via hydraulic fluid. One or more gear clutches 224 may be engaged to change gear ratios between engine 230 and vehicle wheels 214. The output of the torque converter 206 may in turn be controlled by torque converter lock-up clutch 212. As such, when torque converter lock-up clutch 212 is fully disengaged, torque converter 206 transmits torque to automatic transmission 208 via fluid transfer between the torque converter turbine 222 and torque converter impeller 220, thereby enabling torque multiplication. In contrast, when torque converter lock-up clutch 212 is fully engaged, the engine output torque is directly transferred via the torque converter clutch 212 to an input shaft of transmission 208. Alternatively, the torque converter lock-up clutch 212 may be partially engaged, thereby enabling the amount of torque relayed to the transmission to be adjusted. A controller 12 may be configured to adjust the amount of torque transmitted by the torque converter by adjusting the torque converter lock-up clutch in response to various engine operating conditions, or based on a driver-based engine operation request.

Torque output from the automatic transmission 208 may in turn be transferred to wheels 214 to propel the vehicle. Specifically, automatic transmission 208 may adjust an input driving torque at the input shaft (not shown) responsive to a vehicle traveling condition before transmitting an output driving torque to the wheels. Vehicle speed may be determined via speed sensor 230.

Further, wheels 214 may be locked by engaging wheel brakes 216. In one example, wheel brakes 216 may be engaged in response to the driver pressing his foot on a brake pedal (not shown). In the similar way, wheels 214 may be unlocked by disengaging wheel brakes 216 in response to the driver releasing his foot from the brake pedal.

Referring now to FIG. 3, a block diagram of an example evaporative emissions system 300 is shown. Evaporative emissions system 300 includes a canister purge valve 302, a carbon filled canister 304, a bi-directional pump 306, a fuel tank pressure sensor 308, a fuel tank vent valve 312, and a fuel tank 320. Carbon filled canister 304 may include activated carbon 311 to store fuel vapors and a heater 330 to facilitate release of stored hydrocarbons.

Canister purge valve 302 may selectively provide fluidic communication between carbon canister 304 and intake manifold 144. Bi-directional pump 306 may pump air from atmosphere to intake air filter 148 when throttle 162 and canister purge valve 302 are open. Air flow to intake air filter 148 and throttle 162 from bi-directional pump 306 may be improved by fully closing fuel tank vent valve 312. Heater 330 may increase a temperature of air that flows to intake air filter 148 and throttle 162. Bi-directional pump 306 may also pull fuel vapors from fuel 324 in fuel tank 320 through carbon canister 304 where hydrocarbons are stored. The remaining air may be purged to atmosphere.

Conduit 339 provides fluid communication between intake manifold 144 and canister purge valve 302. Conduit 340 provides fluid communication between canister purge valve 302 and carbon canister 304. Conduit 341 provides fluid communication between carbon canister 304 and bi-directional pump 306. Conduit 342 provides fluid communication between carbon canister 304 and fuel tank vent valve 312. Conduit 343 provides fluid communication between fuel tank vent valve 312 and fuel tank 320.

Thus, the system of FIGS. 1-3 provides for a vehicle system, comprising: an engine including an intake air filter; an evaporative emissions system heater; an evaporative emissions system bi-directional pump; and a controller including executable instructions stored in non-transitory memory that cause the controller to activate the evaporative emissions system heater and the evaporative emissions system bi-directional pump in response to an indication of icing of the intake air filter. The vehicle system further comprises a throttle and additional executable instructions to fully open the throttle in response to the indication of icing of the intake filter. The vehicle system includes where the engine is stopped when the evaporative emissions system heater is activated in response to the indication of icing of the intake air filter. The vehicle system further comprises additional executable instructions to close at least one intake valve of the engine in response to the indication of icing of the intake air filter. The vehicle system further comprises additional executable instructions to deactivate the evaporative emissions system heater in response to state of charge of a battery. The vehicle system further comprises additional executable instructions to deactivate the evaporative emissions system heater in response to an amount of time since a most recent activation of the evaporative emissions system heater being greater than a threshold amount of time. The vehicle system further comprises additional executable instructions to activate the evaporative emissions system heater and the evaporative emissions system bi-directional pump in response to an indication of icing of an engine throttle.

Referring now to FIG. 4, an example sequence for deicing an intake air filter is shown. The sequence of FIG. 4 may be provided by the system of FIGS. 1-3 in cooperation with the method of FIG. 5. Vertical markers at times t0-t4 represent times of interest during the sequence. All of the plots occur at a same time. The double SS marks along the horizontal axes represent a break in time in the sequence that may be long or short in duration.

The first plot from the top of FIG. 4 is a plot of an intake air filter state versus time. The vertical axis represents the intake air filter state and the intake air filter is packed with ice when trace 402 is at a higher level near the vertical axis arrow. The air filter is de-iced when trace 402 is at a lower level near the horizontal axis. The horizontal axis represents time and time increases from the left side of the figure to the right side of the figure. Trace 402 represents the state of the air filter.

The second plot from the top of FIG. 4 is a plot of canister purge valve (CPV) state versus time. The vertical axis represents the CPV state and the CPV is open when trace 404 is at a higher level near the vertical axis arrow. The horizontal axis represents time and time increases from the left side of the figure to the right side of the figure. The CPV is fully closed when trace 404 is at a lower level near the horizontal axis. Trace 404 represents the state of the CPV.

The third plot from the top of FIG. 4 is a plot of a carbon canister heater state versus time. The vertical axis represents the carbon canister heater state and the carbon canister heater is on when trace 406 is at a higher level near the vertical axis arrow. The horizontal axis represents time and time increases from the left side of the figure to the right side of the figure. The carbon canister heater is off when trace 406 is at a lower level near the horizontal axis. Trace 406 represents the state of the carbon canister heater.

The fourth plot from the top of FIG. 4 is a plot of an evaporative emissions system pump (e.g., 306) state versus time. The vertical axis represents the evaporative emissions system pump state and the evaporative emissions system pump is on when trace 408 is at a higher level near the vertical axis arrow. The horizontal axis represents time and time increases from the left side of the figure to the right side of the figure. The evaporative emissions system pump is off when trace 408 is at a lower level near the horizontal axis. Trace 408 represents the state of the evaporative emissions system pump.

The fifth plot from the top of FIG. 4 is a plot of fuel tank vent valve (FTVV) state versus time. The vertical axis represents the FTVV state and the FTVV is open when trace 410 is at a higher level near the vertical axis arrow. The horizontal axis represents time and time increases from the left side of the figure to the right side of the figure. The FTVV is fully closed when trace 410 is at a lower level near the horizontal axis. Trace 410 represents the state of the FTVV.

The sixth plot from the top of FIG. 4 is a plot of throttle position versus time. The vertical axis represents the throttle position and the throttle is fully open when trace 412 is at a higher level near the vertical axis arrow. The horizontal axis represents time and time increases from the left side of the figure to the right side of the figure. The throttle is fully closed when trace 412 is at a lower level near the horizontal axis. Trace 412 represents the throttle position.

At time t0, the engine (not shown) is running (e.g., rotating and combusting fuel) and the air filter is not iced. The CPV is closed and the canister heater is off. The evaporative emissions system is off and the FTVV is fully open. The throttle is partially open.

At time t1, the air filter is indicated as being in an iced state. The air filter may become iced due to a vehicle parking against a snow bank or other conditions. The CPV is closed and the canister heater is off. The evaporative emissions system pump is off and the FTVV is open. The throttle is partially open.

At time t2, the engine is stopped (not shown) and the air filter is iced. The CPV is fully closed and the canister heater is off. The evaporative emissions system pump is off and the FTVV is fully closed. The throttle is fully closed.

At time t3, a deicing cycle for the intake air filter begins. The air filter state indicates that the air filter is iced. The CPV is opened and the carbon filled canister heater is activated. The evaporative emissions pump is activated to blow air that is warmed by the heater to the air filter. The FTVV is held closed and the throttle is fully opened to allow air to flow to the air filter.

At time t4, a threshold amount of time has passed since the deicing cycle began. The air filter icing state is returned to the de-iced state and the CPV is fully closed. The carbon canister heater is turned off and the evaporative emissions system pump is turned off. The FTVV is also closed and the throttle is fully closed.

In this way, an intake air filter may be de-iced. The deicing may result from heating ambient air using a carbon canister heater and directing the heated air to the intake air filter. During cold ambient temperature conditions, the fuel tank generates few fuel vapors so that heated air may pass through the carbon filled canister while liberating few if any fuel vapors. The heated air may also de-ice a throttle if the throttle is iced.

Referring now to FIG. 5, an example method 500 for deicing an intake air filter and a throttle are shown. The method also includes determining if the intake air filter and the throttle are iced. At least portions of method 500 may be included in and cooperate with a system as shown in FIGS. 1-3 as executable instructions stored in non-transitory memory. The method of FIG. 5 may cause the controller to actuate the actuators in the real world and receive data and signals from sensors described herein when the method is realized via executable instructions stored in controller memory.

At 502, method 500 determines vehicle operating conditions. Vehicle operating conditions may include but are not limited to ambient air temperature, engine speed, engine air flow amount, driver demand torque or power, spark timing, barometric pressure, intake inlet pressure, and engine air-fuel ratio. Method 500 may determine or infer these conditions from the various sensors mentioned herein. Method 500 proceeds to 504.

At 504, method 500 judges if the engine is off (e.g., not rotating and not combusting air and fuel). Method 500 may judge that the engine is off if the engine is not rotating and if fuel is not presently being injected to the engine. If method 500 judges that the engine is off, the answer is yes and method 500 proceeds to 506. Otherwise, the answer is no and method 500 proceeds to 530.

At 530, method 500 judges if throttle position is following a throttle position command. The throttle position command may be issued by the controller and the throttle position command may be based on a desired or requested engine air flow amount. Method 500 may judge that the throttle position does not follow the throttle position command if the throttle position command deviates from the throttle position command by more than a threshold amount (e.g., 5%). If the throttle position does not follow the throttle position command within a threshold amount and ambient temperature is less than a threshold temperature, method 500 may judge that the throttle may be iced. Otherwise, the answer is no and method 500 proceeds to 534.

At 532, method 500 indicates throttle icing. The throttle icing may be indicated by changing a value of a variable in controller memory. In addition, throttle icing may be indicated via displaying a message at a human/machine interface. Method 500 proceeds to 534.

At 534, method 500 judges if there has been a step change (e.g., a change in differential pressure across the intake air filter that is greater than a threshold amount, such as 20% change in the differential pressure across the intake air filter) in differential pressure across the intake air filter between pressure differential measurements across the intake air filter. In addition, method 500 judges if the ambient air temperature is less than a threshold temperature (e.g., 4° C.). If method 500 judges that ambient air temperature is less than a threshold and that there has been a step change in differential pressure across the intake air filter between pressure differential measurements, the answer is yes and method 500 proceeds to 536. Otherwise, the answer is no and method 500 proceeds to exit.

At 536, method 500 indicates air filter icing. The air filter icing may be indicated by changing a value of a variable in controller memory. In addition, air filter icing may be indicated via displaying a message at a human/machine interface. Method 500 proceeds to exit.

At 506, method 500 judges if the deicing conditions are met. Deicing conditions may be met if throttle icing or air filter icing is indicated. In addition, deicing conditions may be met if an engine is stopped, ambient temperature is less than a threshold temperature, and battery state of charge (SOC) is greater than a threshold SOC. If method 500 judges that deicing conditions are met, the answer is yes and method 500 proceeds to 508. Otherwise, the answer is no and method 500 proceeds to exit.

At 508, method 500 judges if throttle icing is indicated. Method 500 may judge that throttle icing is indicated if a variable in memory is a particular value. If method 500 judges that throttle icing is indicated, the answer is yes and method 500 proceeds to 520. Otherwise, the answer is no and method 500 proceeds to 509.

At 520, method 500 activates the carbon canister heater (e.g., 330) and the evaporative emissions systems pump (e.g., 306). The evaporative emissions system pump is activated so that it draws in ambient air and pumps the air to the carbon canister where it may be heated via the carbon canister heater. In addition, method 500 may fully open the canister purge valve (e.g., 302) and fully close the fuel tank vent valve (e.g., 312) to allow the air to flow into the engine's intake manifold. Method 500 proceeds to 522.

At 522, method 500 may fully close intake valves of the engine's cylinders and command the intake throttle to follow a throttle position command that changes between fully closed and partially opened. Closing engine intake valves may ensure that a larger amount of air is pumped toward the throttle and adjusting the throttle command to change may assist in deicing the throttle. Method 500 proceeds to 524.

At 524, method 500 judges if throttle position is following the throttle position command. If so, the answer is yes and method 500 proceeds to 512. Otherwise, the answer is no and method 500 returns to 520. Additionally, if the throttle position does not match the throttle command after a predetermined amount of time, method 500 may exit and continue to indicate that the throttle is iced. If the throttle position follows the throttle command, the throttle icing indication may be cleared.

At 509, method 500 commands the intake throttle to follow a throttle position command that changes between fully closed and partially opened. Method 500 proceeds to 510.

At 510, method 500 judges if the throttle is following the throttle command to within a threshold amount (e.g., within 5% of the commanded value). If so, the answer is yes and method 500 proceeds to 512. Otherwise, the answer is no and method 500 proceeds to 520.

At 512, method 500 judges if air filter icing is indicated. Method 500 may judge that air filter icing is indicated if a variable in memory is a particular value. If method 500 judges that air filter icing is indicated, the answer is yes and method 500 proceeds to 514. Otherwise, the answer is no and method 500 proceeds to exit.

At 514, method 500 activates the carbon canister heater (e.g., 330) and the evaporative emissions systems pump (e.g., 306). The evaporative emissions system pump is activated so that it draws in ambient air and pumps the air to the carbon canister where it may be heated via the carbon canister heater. In addition, method 500 may fully open the canister purge valve (e.g., 302) and fully close the fuel tank vent valve (e.g., 312) to allow the air to flow into the engine's intake manifold. Method 500 proceeds to 516.

At 516, method 500 may fully close intake valves of the engine's cylinders and command the intake throttle to fully open. Closing engine intake valves may ensure that a larger amount of air is pumped toward the throttle and adjusting the throttle open may increase the flow of heated air to the iced air filter. Method 500 proceeds to 518.

At 518, method 500 judge if a threshold amount of time has passed since the canister heater was activated to de-ice the intake air filter. In addition, method 500 may judge if a battery SOC is less than a threshold. If either condition is true, the answer is yes and method 500 proceeds to exit. Otherwise, the answer is no and method 500 returns to 514.

In this way, it may be possible to de-ice an intake air filter and a throttle. The deicing may be facilitated by operating the emissions system pump so that air flows into the engine's intake manifold rather than from the fuel tank to atmosphere. Thus, the emissions system pump may provide an additional function that is may not otherwise provide.

Thus, the method of FIG. 5 provides for a method for operating an engine, comprising: activating an evaporative emissions system heater and activating an evaporative emissions system pump via a controller in response to an indication of air filter icing. The method further comprises opening a canister purge valve in response to the indication of air filter icing. The method further comprises fully closing a fuel tank vent valve in response to the indication of air filter icing. The method further comprises opening a throttle in response to the indication of air filter icing. The method further comprises deactivating the evaporative emissions system heater in response to a state of charge of a battery. The method further comprises deactivating the evaporative emissions system pump in response to an amount of time passing since a most recent time at which the evaporative emissions system pump was activated. The method includes where the indication of icing is generating while the engine is running. The method further comprises fully closing at least one intake valve of the engine in response to the indication of air filter icing.

The method of FIG. 5 also provides for a method for operating an engine, comprising: activating an evaporative emissions system heater and activating an evaporative emissions system pump via a controller in response to an indication of throttle icing. The method further comprises fully closing at least one intake valve of the engine in response to the indication of throttle icing. The method further comprises opening a canister vent valve in response to the indication of throttle icing. The method further comprises fully closing a fuel tank vent valve in response to the indication of throttle icing. The method further comprises deactivating the evaporative emissions system heater in response to a state of charge of a battery.

Note that the example control and estimation routines included herein can be used with various engine and/or vehicle system configurations. Further, the methods described herein may be a combination of actions taken by a controller in the physical world and instructions within the controller. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A vehicle system, comprising:

an engine including an intake air filter;

an evaporative emissions system heater;

an evaporative emissions system bi-directional pump; and a controller including executable instructions stored in non-transitory memory that cause the controller to activate the evaporative emissions system heater and the evaporative emissions system bi-directional pump in response to an indication of icing of the intake air filter, and additional executable instructions to fully open the throttle in response to the indication of icing of the intake air filter.

2. The vehicle system of claim 1, further comprising additional executable instructions to assess icing of the intake filter while the engine is operating.

3. The vehicle system of claim 1, where the engine is stopped when the evaporative emissions system heater is activated in response to the indication of icing of the intake air filter.

4. The vehicle system of claim 1, further comprising additional executable instructions to close at least one intake valve of the engine in response to the indication of icing of the intake air filter.

5. The vehicle system of claim 1, further comprising additional executable instructions to deactivate the evaporative emissions system heater in response to state of charge of a battery.

6. The vehicle system of claim 1, further comprising additional executable instructions to deactivate the evaporative emissions system heater in response to an amount of time since a most recent activation of the evaporative emissions system heater being greater than a threshold amount of time.

7. The vehicle system of claim 1, further comprising additional executable instructions to activate the evaporative emissions system heater and the evaporative emissions system bi-directional pump in response to an indication of icing of an engine throttle.

8. A method for operating an engine, comprising:

activating an evaporative emissions system heater and activating an evaporative emissions system pump via a controller in response to an indication of air filter icing; and fully closing a fuel tank vent valve in response to the indication of air filter icing.

9. The method of claim 8, further comprising opening a canister purge valve in response to the indication of air filter icing.

10. The method of claim 8, where activating the evaporative emissions system heater and activating the evaporative emissions system pump is performed in further response to the engine being stopped and ambient temperature being less than a threshold temperature.

11. The method of claim 8, further comprising opening a throttle in response to the indication of air filter icing.

12. The method of claim 8, further comprising deactivating the evaporative emissions system heater in response to a state of charge of a battery.

13. The method of claim 8, further comprising deactivating the evaporative emissions system pump in response to an amount of time passing since a most recent time at which the evaporative emissions system pump was activated.

14. The method of claim 8, where the indication of icing is determined while the engine is running.

15. The method of claim 8, further comprising fully closing at least one intake valve of the engine in response to the indication of air filter icing.

16. A method for operating an engine, comprising:

activating an evaporative emissions system heater and activating an evaporative emissions system pump via a controller in response to an indication of throttle icing; and fully closing at least one intake valve of the engine while the engine is off in response to the indication of throttle icing.

17. The method of claim 16, further comprising commanding a throttle to follow an opening and closing trajectory while the engine is stopped.

18. The method of claim 16, further comprising opening a canister vent valve in response to the indication of throttle icing.

19. The method of claim 18, further comprising fully closing a fuel tank vent valve in response to the indication of throttle icing.

20. The method of claim 18, further comprising deactivating the evaporative emissions system heater in response to a state of charge of a battery.

* * * * *